US005366100A

United States Patent [19]

Maglione

[11] Patent Number: 5,366,100

[45] Date of Patent: Nov. 22, 1994

[54] CORRUGATED DISPLAY STAND

[76] Inventor: Stephan T. Maglione, 15 Ava Maria Ct., Millington, N.J. 07946

[21] Appl. No.: 133,990

[22] Filed: Oct. 12, 1993

Related U.S. Application Data

[62] Division of Ser. No. 744,872, Aug. 14, 1991, Pat. No. 5,273,169.

[51] Int. Cl.[5] ..... A47F 5/08

[52] U.S. Cl. ..... 211/153; 211/150

[58] Field of Search ..... 211/149, 150, 132, 72, 211/153, 135; 248/174; 108/111, 112

[56] References Cited

U.S. PATENT DOCUMENTS

| | | | |
|---|---|---|---|
| 1,895,725 | 1/1933 | Nuckols | 248/174 X |
| 3,126,844 | 3/1964 | Burne et al. | 108/111 |
| 3,549,019 | 12/1970 | Wood et al. | 108/111 X |
| 3,687,091 | 8/1972 | Boylan | 108/111 X |
| 3,863,575 | 2/1975 | Kuns et al. | 108/111 |
| 3,987,737 | 10/1976 | Smith | 108/111 |
| 4,151,803 | 5/1979 | Ferrera et al. | 108/111 X |
| 4,271,766 | 6/1981 | Schmiedeler | 108/111 |
| 4,506,790 | 3/1985 | Muscari | 108/111 X |
| 4,582,003 | 4/1986 | Valero | 108/111 |
| 5,273,169 | 12/1993 | Maglione | 211/149 |

OTHER PUBLICATIONS

When Your Products Hit the Road, Shift Their Display set-ups to Automatic.; Autoshelf; Arrow Art Finishers, Flier Sheet.

Automatic! Autoshelf Corrugated Displays, Arrow Art Finishers Co.; Flier Sheet.

Just Look what Corrugated Display Set-up has been reduced to.; Autoshelf; Arrow Finishers; Flier sheet.

*Primary Examiner*—David M. Purol

[57] ABSTRACT

A single corrugated paper board layer with horizontal corrugations is formed into a rear and two doubled over side walls which fold overlapping the rear wall reinforced with a single corrugated corrugated paper board layer. The side walls have doubled over top and bottom edges. A molly type molded thermoplastic fastener and metal grommet assembly secure shelf support ropes to the two side walls via members clamped to the rope ends. Corrugated paper board display shelves fold over into overlapping members via juxtaposed hinge flanges which are secured to the rear wall by the fastener assemblies. The shelves rotate to an open display state where they are supported by the ropes at their front regions. The shelf hinge flanges are apertured to permit one flange to slide relative to the other as the shelves are rotated. The lowermost shelf is formed as a collapsible box-like structure which supports the lowermost regions of the side walls in the open display state and which fold together to form a planar structure in the folded retracted state. The stand external surfaces are waxed to provide a durable washable soil resistant finish. The corrugation paper board laminations are bonded with a moisture resistant adhesive.

9 Claims, 5 Drawing Sheets

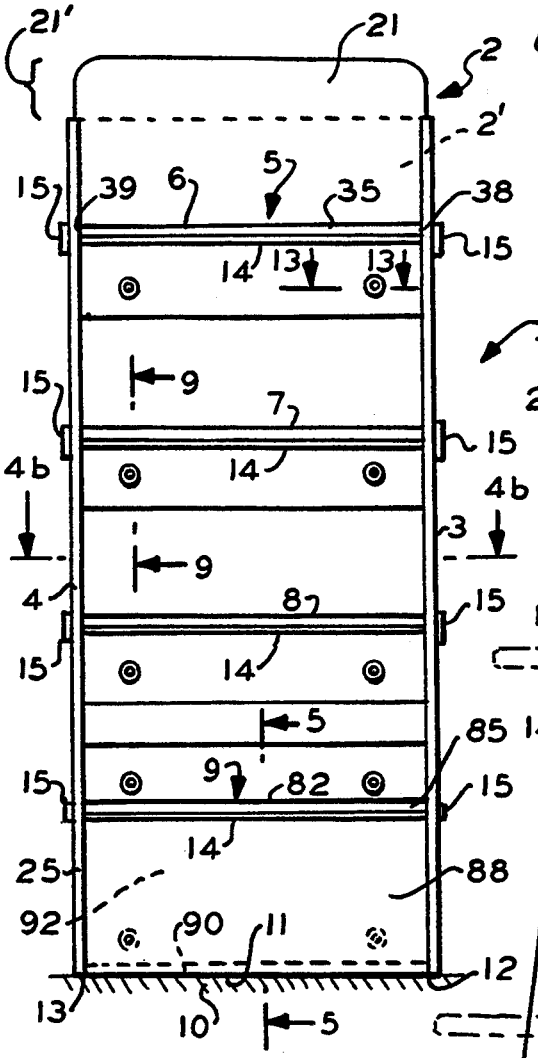
FIG. 4a
FIG. 6
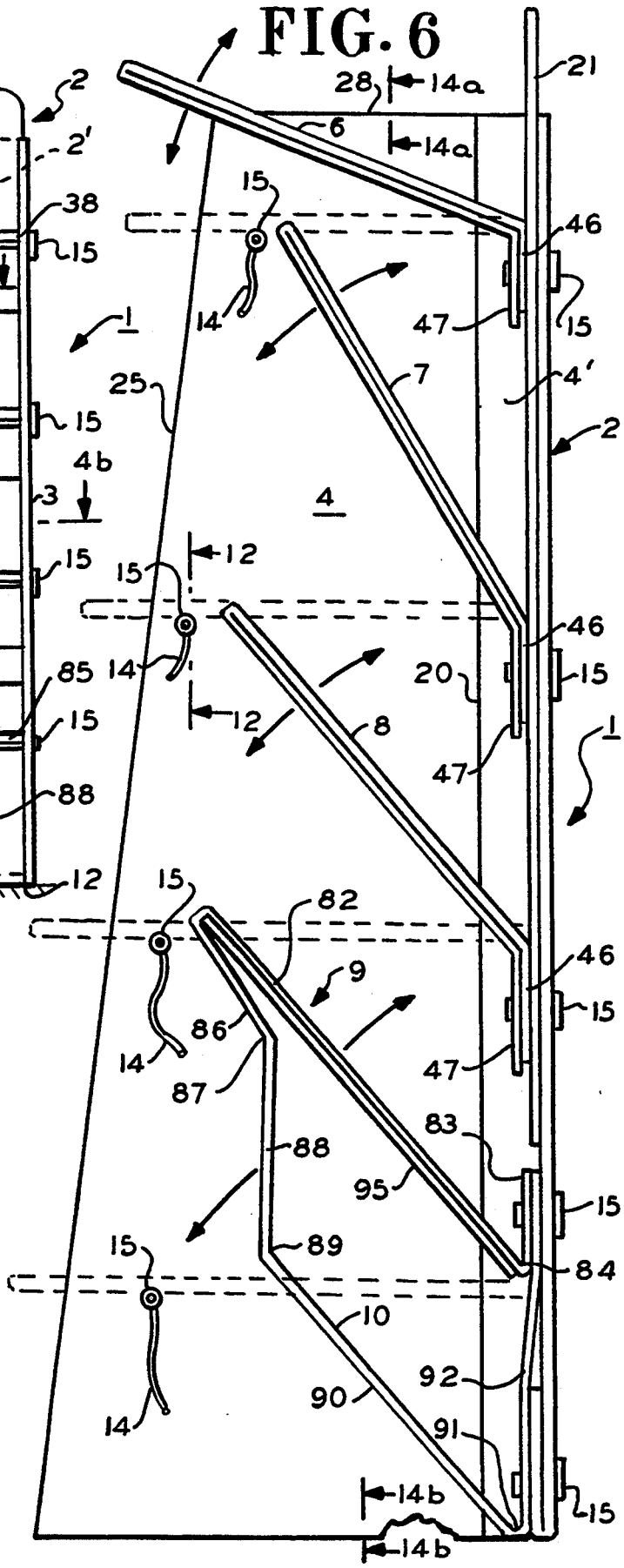

CORRUGATED DISPLAY STAND

This is a division of application Ser. No. 744,872 filed Aug. 14, 1991. now U.S. Pat. No. 5,273,169.

FIELD OF THE INVENTION

This invention relates to corrugated display stands, and in particular, foldable display stands with foldable shelves.

BACKGROUND OF THE INVENTION

Corrugated paper board display stands are widely used at the retail level for display of merchandise for sale to consumers. Many such displays are nothing more than cardboard boxes imprinted with advertising material. Some more sophisticated display stands are foldable to provide portability. These latter stands exhibit a number of problems. These stands comprise a rear wall and two foldable side walls with foldable shelves secured to the rear wall. These tend to be relatively flimsy structures and therefore tend to deteriorate rapidly when folded and unfolded repeatedly for transport to different display sites.

In supermarkets for display of food products the paper board legs stand directly on the supermarket floor and are subject to high moisture exposure, for example, due to liquid spills and even mopping of floors in the adjacent region. The water due to such mopping seeps into the paper board structure, causing delamination of the corrugated layers and warping of the legs. This can cause toppling of the structure and its contents. In addition, high humidity levels in the ambient atmosphere can cause delamination of the corrugated layers destroying the usefulness of the stand. Another problem, the cause of which is not generally understood, is bowing inward of the side walls at the supporting floor region. This bowing action reduces the footprint of the structure causing it to be easily toppled, again spilling its contents. Another problem is general weakness of the rear and side walls which tend to bend while in use due to the weight of objects being displayed and possibly the weight of the structure itself. For this reason these structures typically have their corrugations run vertically in an attempt to provide as much strength to the structure as possible, the corrugations being believed to act like reinforcement ribs to support a vertical load. However, even with the corrugations running vertically such structures are known to bend in response to vertical loads.

Still another problem is that the shelves, typically paper board. While secured to the rear wall need to be supported at their front region. To provide for this supporting action, dowels, typically wooden, are releaseably attached to the side walls at the front region of the side walls just beneath a shelf to be supported. The dowels can easily be lost or misplaced and are cumbersome to deal with in that they represent additional parts that need to be assembled and disassembled and transported with the primary structure forming the display stand. Yet another problem is that the paper board construction becomes soiled relatively quickly, becomes unsightly and needs to be discarded.

SUMMARY OF THE INVENTION

The present inventor recognizes a need for a display stand which overcomes the above problems, is relatively inexpensive, is foldable, durable, exhibits relatively high moisture resistance and is easily assembled and cleaned. A corrugated paper board display stand according to an embodiment of the present invention comprises a sheet of corrugated paper board. The sheet forms a rear wall and at least one side wall integral with the rear wall forming a paper board hinge with the rear wall at an interface therebetween. The structure is free standing foldable multi-sided having a fold state and an open state. The walls fold one over the other in the fold state. The walls stand on a support via a support edge formed by the walls in the open state and define a display space, the walls being adapted to receive and display material in the display space, the corrugations of the sheet being formed by parallel undulations of a sheet paper layer, the undulations preferably extending in a horizontal direction relative to gravity when the stand is supported by the force of gravity on the edge. Surprisingly, the horizontally extending corrugations have relatively high strength in the vertical direction. A shelf for use in the above display stand according to an embodiment of the present invention comprises a sheet member folded at a fold two juxtaposed sheets. A crease is in each of the juxtaposed sheets spaced from an edge distal the fold to form a hinge in that sheet, the crease forming a hinge member between the crease and distal edge of that sheet such that the two sheets between the fold and crease and thereof are each rotatable relative to its corresponding hinge member, the hinge members each having at least one aperture, the hinge members being juxtaposed, the at least one aperture in each of the two sheets being aligned for receiving hinge fastening means therethrough, one of the aligned apertures being enlarged relative to the other to permit the one hinge member to displace relative to the other during rotation of the sheets when fastened to a support by the received hinge fastening means passing through the aligned apertures.

IN THE DRAWING

Figure 1:
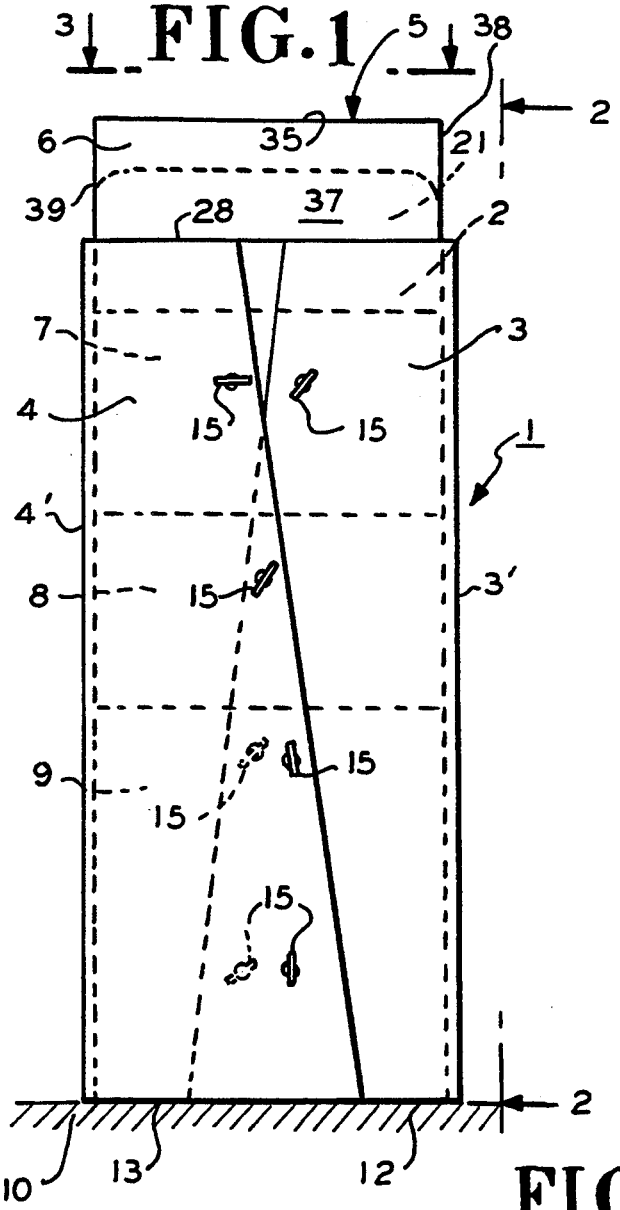
FIG. 1 is a front elevation view of a stand according to one embodiment of the invention in the folded state.
Figure 4B:
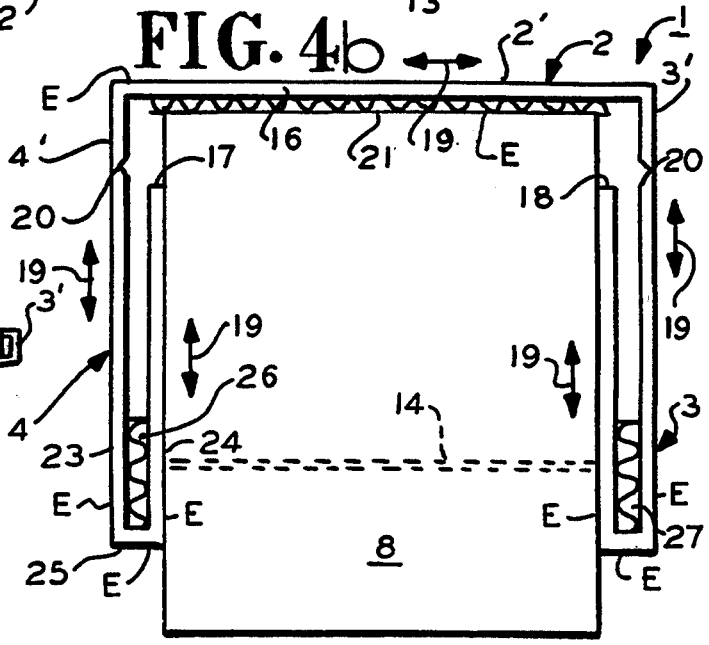
Figure 9:
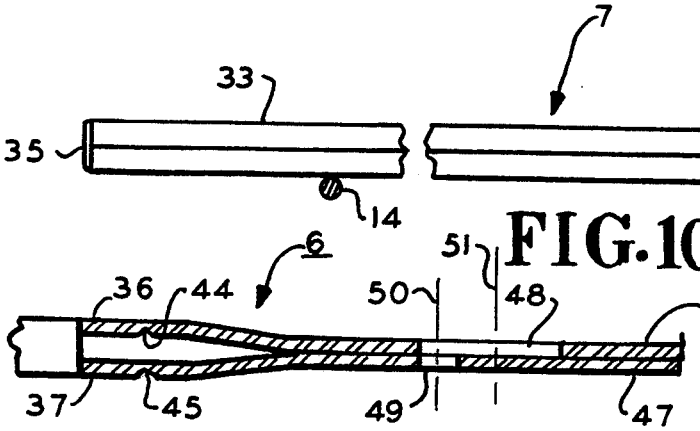
Figure 5:
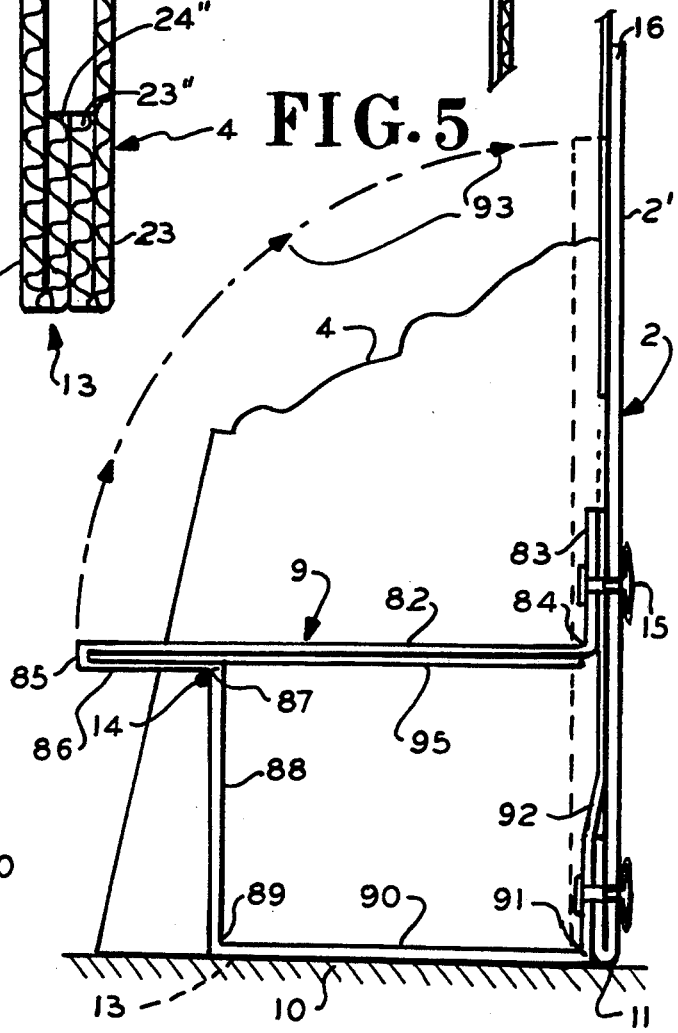
Figure 7:
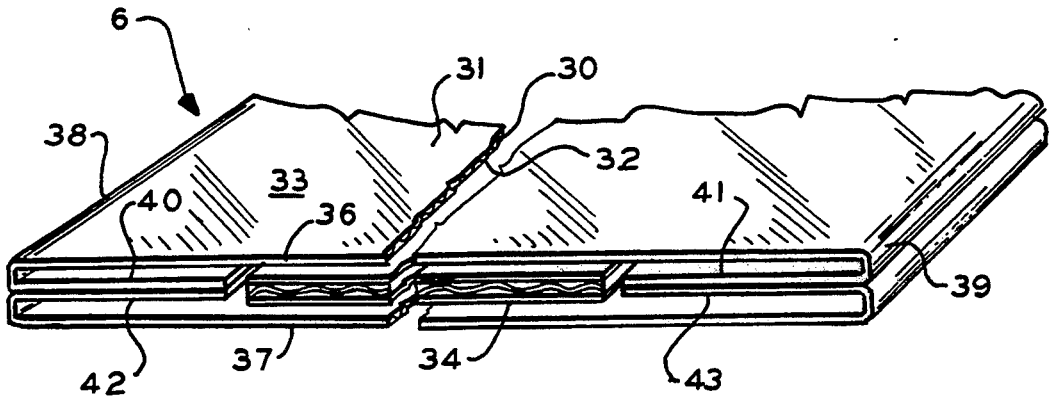
Figure 8:
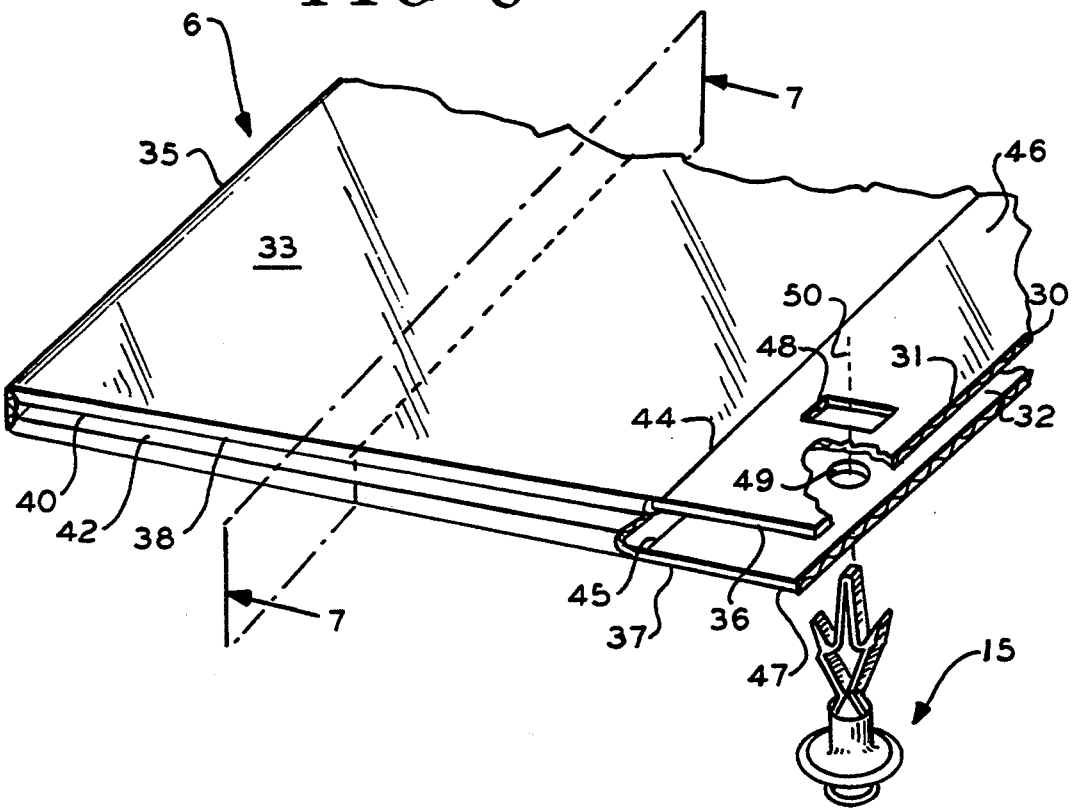

FIG. 4*a* is a front elevation of the stand of FIG. 1 in the open display state;

FIG. 4*b* is a plan sectional view of the stand taken along lines 4*b*—4*b* of FIG. 4*a*;

FIG. 5 is a side sectional elevation view of the embodiment of FIG. 4*a* taken along lines 5—5 of FIG. 4;

FIG. 6 is a side sectional elevation view of the stand of FIG. 4*a* in a partially folded retracted state;

FIG. 7 is an isometric view of a transverse portion of a typical shelf of the stand of FIG. 1 taken in the plane 7—7 of FIG. 8;

FIG. 8 is an isometric fragmented view of a typical shelf disassembled from the rear and side walls of the stand and taken in a direction with the front edge to the left in the drawing Figure;

FIG. 9 is a sectional elevation view taken along lines 9—9 in FIG. 4*a;*

Figure 10A:
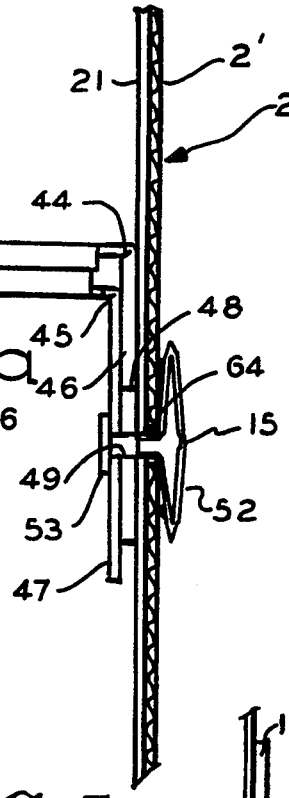
Figure 14A:
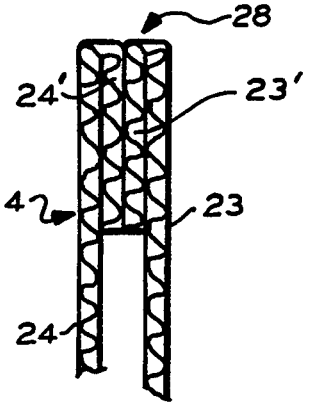
Figure 14B:
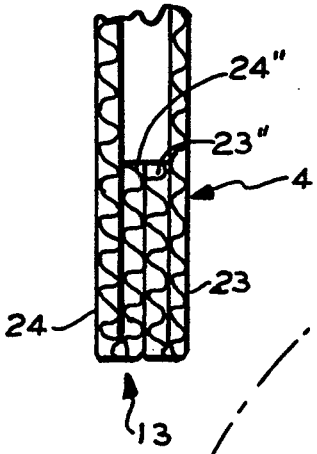
Figure 10B:
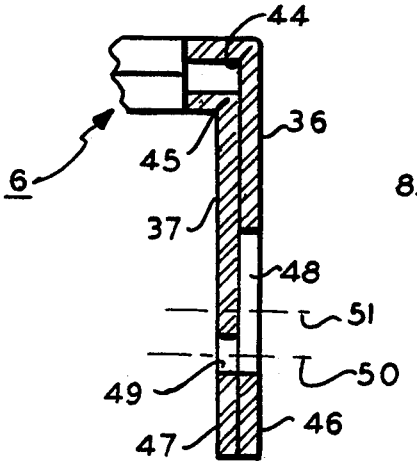
Figure 13:
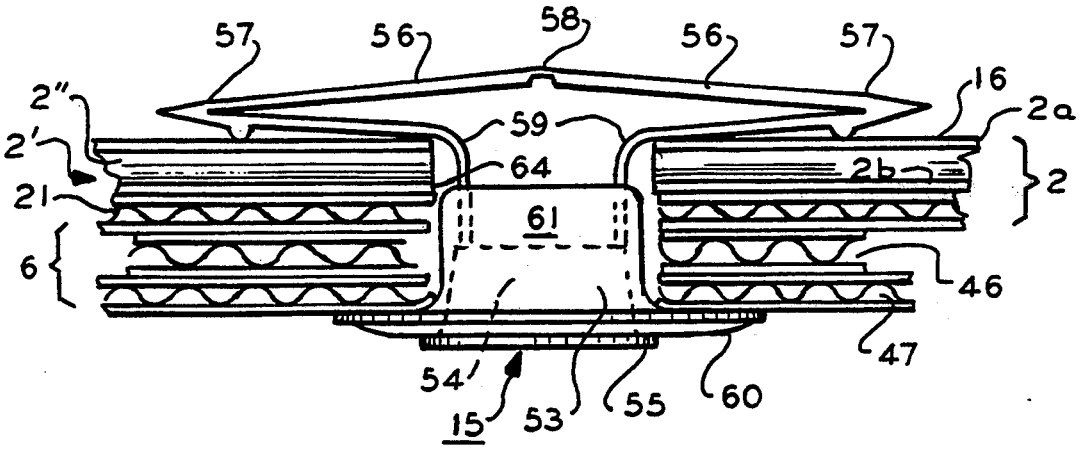
Figure 12:
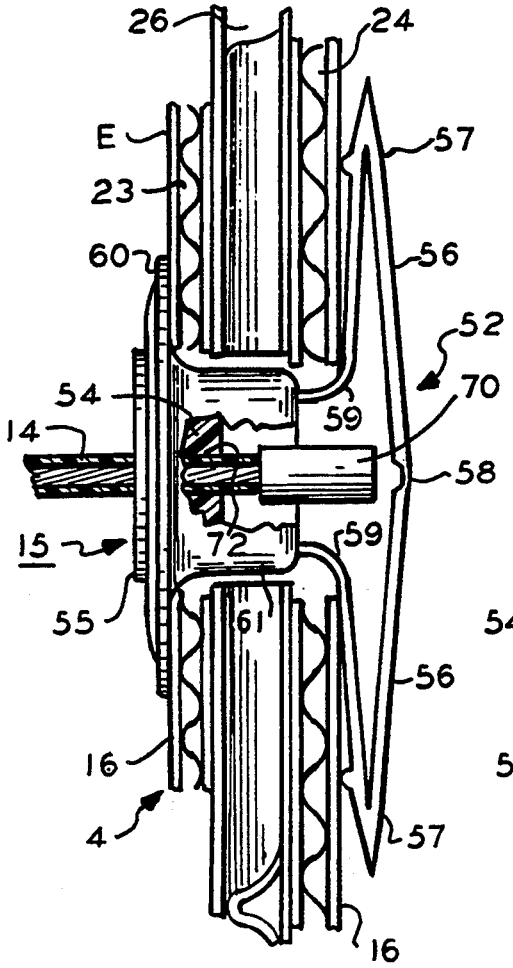
Figure 11:
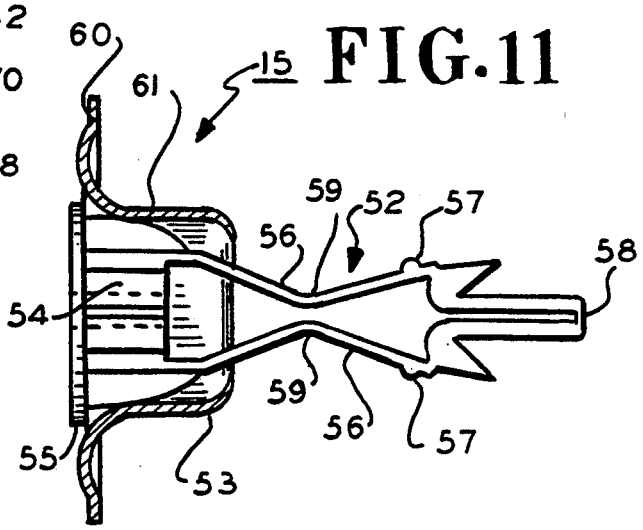

FIGS. 10*a* and 10*b* are elevation side sectional views of a typical shelf showing the relative relation of the hinge tastening apertures in the retracted folded and unfolded extended display states, respectively; FIG. 10*b* corresponding to the state of FIG. 9;

FIG. 11 is a side elevation view of a typical fastener employed in the embodiment of FIG. 1;

FIG. 12 is a side elevation sectional view through a typical rope connection to a side wall taken along lines 12—12 of FIG. 6;

FIG. 13 is a sectional view through a typical fastener connection for connecting the hinges of a shelf to the rear wall taken along lines 13—13 in FIG. 4*a*; and FIGS. 14*a* and 14*b* are sectional fragmented views taken along respective lines 14*a*—14*a* and 14*b*—14*b*of FIG. 6 showing a representative folded over quadruple thickness at the top and bottom edges, respectively, of the side walls.

DESCRIPTION OF THE PREFERRED EMBODIMENT

Figure 2:
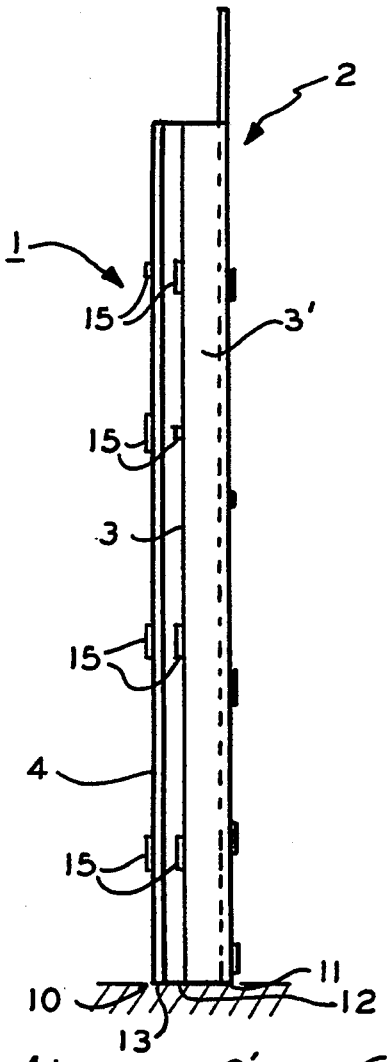
FIG. 2 is a side elevation view of the embodiment of FIG. 1 taken along lines 2—2 of FIG. 1.
Figure 3:
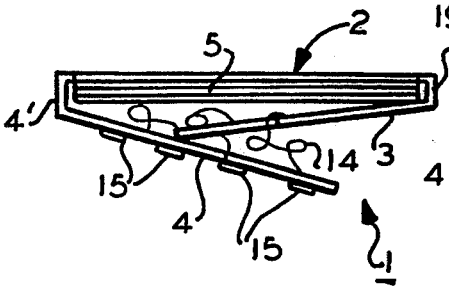
FIG. 3 is a plan view of the embodiment of FIG. 1 taken along lines 3—3 FIG. 1.

In FIGS. 1, 2 and 3 display stand 1 shown in the folded retracted state comprises a rear wall 2 and two side walls 3 and 4, which are identical in this embodiment. A side wall portion 3' of side wall 3 remains unfolded approximately normal to rear wall 2. A side wall portion 4' of side wall 4 also remains unfolded and is also approximately normal to the rear wall 2. Enclosed in the box-like structure formed by walls 2, and 3 and 4 and wall portions 3' and 4' is an array 5 of four folded retracted shelves 6–9. The shelves and the walls all comprise corrugated paper board as will be explained in more detail below. The entire structure is light weight and easily transportable in the folded state. In FIG. 1 the stand is shown erect in an orientation in which it would normally rest on a floor 10 in the open state as shown in FIG. 4*a*. In this orientation, the stand rests on lower rear wall edge 11 and side wall edges 12 and 13 of side walls 3 and 4 respectively, edges 12 and 13 being continuous with wall portions 3' and 4' and edge 11.

In FIG. 4*a*, a rope 14 is secured at opposite ends thereof to walls 3 and 4 beneath the front portion of each shelf. An exemplary rope position relative to shelf 9 is shown in FIG. 5 and relative to shelf 7 in FIG. 9. The ropes 14, which preferably are stranded steel wire coated with a thermoplastic coating, are anchored at opposite ends to the side walls 3 and 4 by identical anchoring assemblies 15.

In FIG. 4*b* (and FIGS. 12 and 13), the stand body comprising the rear and side walls 2, 3, 4, 3' and 4' is formed of a primary structure comprising a single corrugated paper board sheet 16. The sheet 16 comprises a single corrugation layer 2", FIG. 13, sandwiched between membrane layers $2_a$ and $2_b$. The shelves are constructed similarly. The undulations of the corrugations of sheet 16 layer 2' run in a horizontal direction relative to gravity from end 17 of side wall 4 to end 18 of side wall 3 in the direction of arrows 19. Surprisingly, this provides improved load support strength over typical prior undulation directions which are normal to the directions of arrows 19, i.e., the undulations run vertically.

The sheet 16 has vertical creases 20 in walls 3 and 4 for hinging walls 3 and 4 relative to wall portions 3' and 4', respectively. Rear wall 2 comprises a wall 2' formed by sheet 16 and a reinforcing member 21 bonded to the wall 2'. The corrugations of member 21, which is constructed similarly as sheet 16 of a single corrugation layer between outer membrane layers, run vertically normal to the corrugations of sheet 16 layer 2'. The member 21 serves a cosmetic function as well in that it is visibly behind the shelves in front of wall 2' and extends above the wall 2' a portion 21'. In this way the external surfaces E of the sheet 16 and member 21 may have a cosmetically appealing finish on one side only. In this case the inside surface of wall 2' and the surface of facing member 21 are unfinished. Member 21 thus has a one sided finish E which faces the shelves. The cosmetic finish E includes a coloring, for example white, and may include printed decorations or advertising as applicable, and protected with a water impervious wax coating which resists soiling and moisture penetration. The entire external surface of the side walls facing the shelves and opposite directions are so cosmetically finished.

The layers 2', $2_a$ and $2_b$ forming the corrugations of sheet 16 and all of the corrugated structures including the shelves to be described below are formed by a water resistant adhesive such as a starch. This tends to prolong the life of the structure precluding delamination due to moisture absorption as occurs with laminations formed by non-water resistant adhesives.

In FIG. 4*b*, side wall 4 comprises portions 23 and 24 in which portion 24 is folded over at the wall front edge 25, which is tapered (FIG. 1), to form a double thickness wall 4. Wall 3 is folded over similarly. A corrugated reinforcing strip 26 is between portions 23 and 24 adjacent to edge 25 in wall 4 and a similar strip 27 is in wall 3. The strips 26 and 27 reinforce the side walls where the rope 14 anchor fastener assemblies 15 are attached to the side walls. In FIG. 14*a*, the top edge 28 of representative wall 4 is folded over with lip 23' formed from portion 23 and lip 24' formed from portion 24. In similar fashion, FIG. 14*b*, the bottom edge 13 of wall 4 is formed with folded over lips 23" and 24" formed from respective portions 23 and 24. In this way both the top and bottom edges of the side walls have a waxed finished external surface to protect the paper board from damaging moisture as well as reinforcing the structure at the edges which take the most abuse in use.

In FIGS. 7 and 8, representative shelf 6 is shown. This shelf is representative of shelves 7 and 8. Shelf 9 is of different construction as will be explained in connection with FIG. 5. Shelf 6 comprises a single corrugated layer 30 bonded between two outer sheet membrane layers 31 and 32 to form a corrugated sheet 33. The shelf 6 is formed of this single sheet 33 and a reinforcement sheet 34. The sheet 33 is bent over at the front edge 35 of the shelf opposite the rear wall to form a dual member structure comprising members 36 and 37 juxtaposed one over the other. The member 36, FIG. 7, is bent over at its side edges 38 and 39 to form folded over lips 40 and 41, respectively. Member 37 is bent over at edge 38 to form lip 42 overlapping and abutting lip 40 and at edge 39 to form lip 43 overlapping and abutting lip 41. Edges 38 and 39 face respective side walls 3 and 4 in the unfolded display state of FIG. 4*a* and the respective side wall portions 3' and 4' in the folded retracted state of FIG. 1. The reinforcing sheet 34 of a single corrugation layer between two outer membrane layers is between the lips 40 43 of shelf 6 and between members 36 and 37.

In FIG. 8, member 36 has a fold crease 44 and member 37 has a fold crease 45 running transversely the sheet parallel to the front edge 35. The creases 44 and 45 form respective hinges for flange portions 46 and 47 of members 36 and 37. Portions 46 and 47 are single corrugation sheets without a doubled over lip. Flange portions 46 and 47 have two pairs of aligned respective apertures 48 and 49, only one pair being shown in the Figure. The aperture 48 is an elongated rectangular opening in member 36 and aperture 49 is a circular opening whose diameter is about the same as the length of the shorter side of the aperture 48. Aperture 49 closely receives a fastener assembly 15. The longer dimension of aperture 48 extends from the shelf front to rear. In the Figures, identical parts have the same reference numerals.

In FIG. 10*a*, a typical shelf 6 is shown with its hinged flange portions 46 and 47 coplanar with the remainder of the shelf. In this position the shelf normally would be folded upward in the retracted position to the right in FIG. 6 abutting the rear wall 2 reinforcing member 21 in a vertical orientation with its hinge flanges overlapped by lower shelf 7 which is overlapped by lower shelf 8 and so on. In FIG. 10*a* the rectangular aperture 48 is aligned with the lower aperture 49 at axis 50 on one side of axis 51 of aperture 48. The center of the longer dimension of aperture 48 is at axis 51. When the hinged flange portions 46 and 47 are bent over relative to the remainder of the shelf in the open unfolded display position, their relative orientation is shown in FIG. 10*b*. This corresponds to the position of shelf 7 in FIG. 9. In this orientation, aperture 49 displaces relative to its position in FIG. 10*a* to the opposite side of the aperture 48 as shown. Thus, when fastener assembly 15 is assembled closely received in aperture 49, the assembly 15 being locked to the rear wall as explained below, hinge flange portion 46 can displace by way of the elongated aperture 48 sliding relative to the fastener assembly 15.

The same construction of assembly 15 is used to fasten the shelves to the rear wall 2 and to anchor the ropes 14 to the side walls 3 and 4. In FIG. 11 representative assembly 15 is shown. Assembly 15 comprises a molded thermoplastic molly type fastener 52 which is commercially available. The fastener 52 is inserted in a commercially available grommet 53 which is stamped metal. The fastener 52 comprises a cylindrical ribbed head 54 having an annular flange 55. Molded integral with the head 54 are a pair of identical planar sheet member legs 56. The legs each have a hinge 57 and are connected at their extended ends by a hinge 58. When the legs are compressed at hinge 58 toward the head 54, the legs bend at region 59, hinges 57 and 58 to form a locking device as shown in FIGS. 12 and 13, and remains in this position unless forced in the reverse direction to a release mode of FIG. 11 manually.

The grommet 53, FIG. 11, comprises an annular disk-like flange 60 of larger diameter than annular flange 55 of fastener 52. The flange 60 is integral with an annular cylindrical body 61 which is hollow and receives the fastener 52 therethrough. The body 61 has a smooth curved external surface which gradually joins the flange 60 and thus readily mates with the corrugated closely received apertures 49 of the shelf hinges or of the rear wall 2 whose apertures are substantially the same dimension as aperture 49 of the shelves. The smooth gradual joint of body 61 with flange 60 crushes the edge of the mating corrugated sheet somewhat without tearing. The flange 60 is of sufficient area to provide good load support in the presence of high tension on the assembly 15 tending to pull the assembly through the corrugated mating wall.

In FIG. 9, a fastener assembly 15 is shown in a typical arrangement for attaching the hinged flanges 46 and 47 of the shelves 6, 7 and 8 to the rear wall 2 via an aperture 64 in the rear wall. The aperture 64 closely receives the fastener 52 grommet 53. FIG. 13 shows the fastener assembly of FIG. 9 in more detail in the locked condition. To unlock the fastener, the legs 56 at hinges 57 are pushed together to return the fastener to the condition of FIG. 11, and the assembled sheets unlocked by slipping the fastener out of the corresponding apertures of the corrugated sheets.

In FIG. 12, representative rope 14 is anchored to fastener 52 by clamp 70 which is clamped to an end of the rope 14. The rope 14 passes through hole 72 in head 54 of the fastener 52. The clamp 70 is a brass member of larger diameter than the hole 72 to prevent the rope from pulling through the hole 72 to the left in the Figure. All ropes are similarly anchored. Thus the same fastener 52 can be used to attach the shelves as well as anchor the ropes. The ropes thus always remain secured to the side walls requiring no field assembly or disassembly. Further, the ropes being flexible readily coil or flex in response to the folding and retraction of the stand 1 to the state of FIG. 1.

When the side walls are unfolded to the display state of FIG. 4*a* the rope is pulled relatively taut. Then the shelves are rotated, FIG. 6, down to the horizontal orientation shown in phantom so that they abut the corresponding rope 14. Each rope is beneath a corresponding shelf so that shelf rests on and is supported by that rope. The fasteners 52 provide a relatively large footprint on the side wall to which they are anchored to provide a relatively high support load for the resulting tension load on the rope when the shelves are loaded with display merchandise.

In FIG. 5, shelf 9 is of a different configuration than the other upper shelves 6–8. Shelf 9 comprises a single corrugated sheet which is not folded over at its edges as the other shelves so that the corrugation layer is exposed at the shelf edges facing the side walls 3 and 4. Shelf 9 comprises a shelf member 82, a reinforcing corrugated paper board member 95 and a hinged flange 83 secured to rear wall 2 by two spaced fastener assemblies 15 (only one of which is shown in the Figure) so that the flange 83 is fixedly secured to the wall 2 and comprises a single layer at the wall 2. Member 95 is bonded to member 82 with a water resistant adhesive. The flange is hinged to shelf member by a hinge crease 84 in the shelf member. The shelf member 82 is folded at front edge 85 to form a lower shelf member portion 86 which extends rearward toward wall 2 to a point where portion 86 just overlaps and abuts rope 14. At rope 14 a crease 87 in the sheet forms a hinge for front member 88 which depends vertically from rope 14 between rope 14 and the rear wall 2 to crease 89 forming another hinge. Crease 89 is adjacent to the bottom edges 12 and 13 of the side walls, FIG. 4*a*. The crease 89 hinges bottom wall 90 to member 88, wall 90 resting on the support floor 10. The lower surface of wall 90 is coplanar with edges 11 and 12 and 13 in the open display state of FIG. 5. A rear member 92 is hinged to bottom wall 90 by crease 91. Member 92 extends upward abutting rear wall member 2' parallel in this state to front member 88. The fastener assembly 15 secures the member 92 between and to the flange 83 and rear wall member 2'.

When the shelf 9 is rotated counterclockwise in FIG. 5 in the direction of arrows 93 to the position shown in phantom abutting rear wall 2 in the folded retracted state, the member 88 and bottom wall 90 in articulated fashion rotate relative to each other so that they and portion 86 become substantially coplanar and are juxtapose with shelf member 82 to form a two layer thick retracted structure.

The member 82, front member 88, bottom wall 90 and rear member 92 form a box-like structure in the open display state of FIG. 5. In this state, the box-like structure is closely fitted between side walls 3 and 4 between corresponding rope 14 and the bottom edges of the stand. This box-like structure provides a transverse support beam which prevents the side walls from toeing inward toward each other as might otherwise occur in the absence of the box-like structure. In other words, if a shelf such as shelves 6–8 were used in the position of shelf 9 without the box-like structure, the side walls 3 and 4 in use in the open state would tend to bend inward. reducing the supporting footprint width between the side walls and possibly resulting in the stand toppling. Such toppling is thus prevented by the shelf 9 construction.

As shown in FIG. 6, the shelves are all of sufficient front to rear depth so as to provide a good proportion to their width between the side walls. Yet the shelves must be so dimensioned and positioned relative to the ropes so as to clear the ropes when the shelves are rotated between the folded retracted states and the open display state. This requires a compromise of rope position, shelf position and shelf dimensions which are approximately to scale in FIG. 6 to illustrate these proportions. Even though the lowermost shelf 9 is supported by the front member 88, further high strength support is provided by rope 14 which supports the primary shelf member 82, FIG. 5.

The fasteners 52 of assemblies 15 being molded of thermoplastic material can be of any desirable color. In the case where finish E is white, a white thermoplastic and a silver colored stamped sheet metal grommet 53 provide an attractive color coordinated display stand. The waxed finish E provides a durable lasting finish with an attractive sheen that is soil resistant and which washes readily. The resulting stand can be repeatedly folded and unfolded, transported and used to store and display merchandise with relative longevity as compared to prior art stands. The stand of the present invention presents a clean professional look that exhibits high strength and durability that is sufficiently lightweight to be easily portable. The water resistant adhesive bonding the different layers and members also enhances longevity to the structure and lends itself to the rigors of commercial use in conventional retail environments.

What is claimed is:

1. A shelf for use in a display stand comprising:

a sheet member folded at a fold to form two juxtaposed sheets; and a crease in each of the juxtaposed sheets spaced from an edge distal said fold to form a hinge in that sheet, said crease forming a hinge member between the crease and distal edge of that sheet such that the two sheets between the fold and crease thereof are each rotatable relative to its corresponding hinge member, said hinge members each having at least one aperture, said hinge members being juxtaposed, the at least one aperture in each of the two sheets being aligned for receiving hinge fastening means therethrough, one of said aligned apertures being enlarged relative to the fastening means portion passing therethrough to permit the one hinge member to displace relative to the other during rotation of said sheets when fastened to a support by said received hinge fastening means passing through said aligned apertures.

2. The shelf of claim 1 wherein said sheets are corrugated paper board, the corrugations of said paper board running in a direction from one hinge to the other hinge.

3. The shelf of claim 1 wherein said shelf has opposing edges between the fold and said creases, said sheets being folded over at said opposing edges to form a double thickness at each said opposing edges.

4. The shelf of claim 1 including a corrugated shelf support and said fastening means for securing said shelf to said support.

5. The shelf of claim 4 wherein said fastening means comprises a fastener having a body, a flange member secured to the body and locking leg members having an extended condition for insertion in said apertures and a folded bent condition for locking the fastener to said hinges and support between said flange member and locking leg members.

6. The shelf of claim 5 wherein said flange member has a locking flange area for engaging one of said hinges and support, said fastening means including a grommet member for providing an enlarged flange area relative to said locking flange area for engaging one of said hinges and support and said flange member.

7. The shelf of claim 1 wherein the enlarged aperture is an elongated slot and the other aperture is circular.

8. The shelf of claim 7 further including the support and fastening means secured to the support, the fastening means comprises an elongated fastener which passes through the apertures closely received in the other aperture and wherein the hinge member with the slot linearly displaces relative to the other hinge member during the rotation of the shelf relative to the hinge members and support.

9. The shelf of claim 7 wherein the slot has an elongated dimension greater than a transverse dimension, the elongated dimension extending transverse the hinge of that sheet.

* * * * *